United States Patent [19]

Roach

[11] Patent Number: 4,894,878

[45] Date of Patent: Jan. 23, 1990

[54] SLEEPING BAG

[75] Inventor: Raegan L. Roach, Chico, Calif.

[73] Assignee: Caribou Mountaineering, Inc., Chico, Calif.

[21] Appl. No.: 198,274

[22] Filed: May 25, 1988

[51] Int. Cl.[4] ..... A47G 9/08

[52] U.S. Cl. ..... 5/413; 2/69.5; 2/272

[58] Field of Search ..... 2/69.5, 84, 88, 97, 2/221, 272; 5/413, 485, 494, 502

[56] References Cited

U.S. PATENT DOCUMENTS

| | | | |
|---|---|---|---|
| 2,064,458 | 12/1936 | Bulpit . | |
| 2,179,424 | 11/1939 | Phillips et al. . | |
| 2,341,069 | 2/1944 | Anderson . | |
| 2,379,416 | 7/1945 | Clark . | |
| 2,581,357 | 1/1952 | Burstein . | |
| 3,110,903 | 11/1963 | Burchard | 2/221 |
| 3,178,734 | 4/1965 | Carrez | 5/413 |
| 3,584,323 | 9/1969 | Worley . | |
| 3,639,931 | 2/1972 | McGuire . | |
| 3,787,906 | 1/1974 | Hunt . | |
| 3,831,206 | 8/1974 | Geary . | |
| 3,837,021 | 9/1974 | Sellers et al. | 5/502 |
| 3,959,834 | 6/1976 | Hunt | 2/69.5 |
| 4,090,269 | 5/1978 | Hunt . | |
| 4,294,242 | 10/1981 | Cowans . | |
| 4,787,105 | 11/1988 | Phillips et al. | 5/413 |

FOREIGN PATENT DOCUMENTS

| | | | |
|---|---|---|---|
| 2471167 | 6/1981 | France | 5/413 |

OTHER PUBLICATIONS

Campmor Publicatino, Mid-Summer 1985.
Caribou Sleeping Bag Brochure, Published 1987.

*Primary Examiner*—Michael F. Trettel
*Attorney, Agent, or Firm*—Townsend and Townsend

[57] ABSTRACT

A sleeping bag (2) includes an outer shell (4), an inner liner (6) and a plurality of longitudinally extending insulating batts (24) therebetween secured along their longitudinal edges (20, 22) to the shell and to the liner in an overlapping, shingled arrangement. The circumferential dimension of the liner can be reduced by connecting spaced apart zipper elements (50, 52) fastened to the liner, thus causing an increased overlap of the batts resulting in increased thermal insulation. A cord casing (60) at the head hole (16) is secured to the liner along a line (64) spaced apart from the seam (66) joining the shell and the liner at the head hole so that when the draw string (68) is pulled taut, creasing and other deformation of the shell surrounding the head hole is minimized so to reduce any decrease in thermal insulation. The head and foot of the bag define three dimensional cavities sized to generally conform to the user's head and feet to minimize compression of the bag. The access zipper extends beneath the user to minimize heat loss.

32 Claims, 2 Drawing Sheets

SLEEPING BAG

BACKGROUND OF THE INVENTION

There have been many advances in the design of sleeping bags. One improvement has been to use overlapping batts of insulating material between the outer shell and the inner liner. These batts are positioned to extend laterally from one side of the longitudinally placed access zipper to the other side of the longitudinally placed access zipper. One lateral edge of each of the batts is secured to the outer shell and the other lateral edge is secured to the inner liner. It is these lateral seams which are seen on many modern sleeping bags to give the sleeping bag a quilted look. Even though the stitching does not go all the way through the bag, it does create needle holes in the shell and the liner.

SUMMARY OF THE INVENTION

The invention is directed to a sleeping bag having longitudinally extending, overlapping insulation batts.

The sleeping bag includes an outer shell, an inner liner and a plurality of the longitudinally extending insulating batts in the insulating region between the liner and the shell. The batts are oriented longitudinally, that is between the head of the bag and the foot of the bag. The batts are secured to the shell and the liner in an overlapping, shingled arrangement. At least some, and preferably most, of the batts are secured along one longitudinal edge to the liner and along the other longitudinal edge to the shell.

The use of longitudinally extending insulation batts has several advantages over conventional stuffed insulation and over circumferentially extending batts. The longitudinally extending batts drape lengthwise over the user's body in a continuous blanket of insulation. The batts follow the body curves so the amount of air movement, and resulting heat loss, is reduced. The absence of circumferential stitching reduces "tension bias" running laterally across the user's body, present in sleeping bags having conventional circumferentially arranged batts, for increased comfort.

The longitudinally extending, overlapping batts are preferably arranged in a pyramid arrangement. The batts can be placed so that two sets of batts are used. The sets of batts are shingled in opposite rotary directions so that the sets of batts meet along abutting edges along the top of the bag and at or near the bottom of the bag. Preferably the butting edges of the batts at the top of the bag meet at the centerline of the bag and are secured to the inner liner. In this configuration the upper abutting edges are covered by a centrally positioned batt having both of its longitudinal edges secured to the outer shell. The abutting edges of the batts at or near the bottom of the bag preferably meet at the access zipper.

The pyramid arrangement has several advantages. It creates a consistent, uniform layer of insulation while at the same time stabilizing against body movements of the user. With the pyramid arrangement the overlap of the batts on the top of the bag can be increased, thus increasing the thermal insulation. This is accomplished by reducing the circumferential dimension of the liner, such as by using spaced apart zipper elements fastened to the liner. Joining the zipper elements draws the batts toward one another to increase the amount of overlap above the user, thus increasing insulation. Doing so does not cause any decrease in the size of the outer shell so the total volume of the insulating region increases to further increase the dead air space for increased thermal insulation.

To reduce air leakage through needle holes in the outer shell, and preferably the inner liner as well, the outer shell and inner liner are made of longitudinally extending panels sewn together at inwardly directed (that is, into the insulating region between the shell and the liner) seams. The panels are sized and the seams are positioned so that the batts are sewn to the seam allowances extending into the insulating region rather than to the surfaces of the shell or the liner.

The sleeping bag preferably includes a head hole at the head with a cord casing for reducing the size of the head hole for greater user comfort. The cord casing is secured to the liner along a line spaced apart from the seam joining the shell and the liner. Due to this placement, when the draw string of the cord casing is pulled taut, creasing and other compression of the shell surrounding the head hole is reduced in comparison with securing the cord casing at the shell/liner seam. Since the volume of the insulating region is not substantially reduced by pulling on the draw string, high thermal insulation in the region surrounding the head hole is maintained.

A further feature of the invention relates to the longitudinally extending access zipper. The access zipper preferably extends beneath the user to substantially eliminate radiant and convective heat losses through the zipper. In addition, instead of a bulky draft tube, as used with conventional bags, which cannot follow the curves of the zipper and thus is often spaced apart from the zipper, a thin draft flap is preferably used with the invention. The draft flap is made from a very flexible insulating material, flexes with the zipper and stays close to the zipper to reduce air exchange through the zipper. The flexible draft flap also makes lying on the zipper, which is preferably beneath but not centered beneath the user, comfortable.

The use of overlapping, longitudinally extending shingled batts facilitates the incorporation of another aspect of the invention. The side panels help to keep the insulation along the top edges and the sides of the bag from compressing to the extent as occurs with conventional bags. Preventing compression of the insulation helps to keep the insulating value along the sides of the bag high.

the head and the foot of the bag are also specially designed for maximum thermal efficiency. Both are shaped to create three-dimensional interiors which minimize compression of the bag down onto the user's head and feet while also minimizing dead air space.

Other features and advantages of the invention will appear from the following description in which the preferred embodiments have been set forth in detail in conjunction with the accompanying drawings.

DETAILED DESCRIPTION OF THE PREFERRED EMBODIMENT

Figure 1:
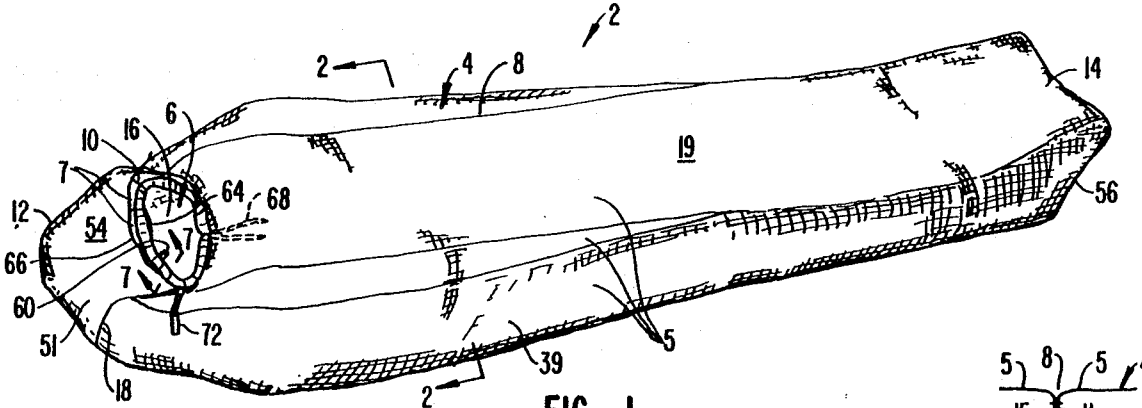
FIG. 1 is a top view of a sleeping bag made according to the invention showing the head hole and longitudinally extending seams.

Turning now to the figures, a sleeping bag 2 is seen to have an outer shell 4 and an inner liner 6. Shell 4 and liner 6 are made by joining shell and liner panels 5 and 7 to one another to form longitudinal seams 8 and 10, most of which extend from the head 12 of bag 2 to the foot 14 of the bag. Seam allowances 11 at seams 8 of shell 4 extend into the insulating region 15 between shell 4 and liner 6 as shown in FIG. 1A. Similar seam allowances 11 extend into region 15 at seams 10 of liner 6. Shell 4 and liner 6 can be made of woven or non-woven material. A head hole 16 is formed at head 6 of bag 2. An access zipper 18, used for user access into sleeping bag 2, extends from head hole 16 along the top 19 of bag 2 down around to extend a substantial distance along the bottom 21 of the bag.

The outer and inner longitudinal edges 20, 22 of longitudinally extending insulation batts 24, which are positioned in insulating region 15 between shell 4 and liner 6, are sewn to seam allowances 11. Doing so eliminates needle holes in shell 4 and liner 6. Batts 24 extend from head 12 to foot 14 of bag 2 and, as illustrated in FIG. 2, are arranged in an overlapping, shingled arrangement.

Figure 2:
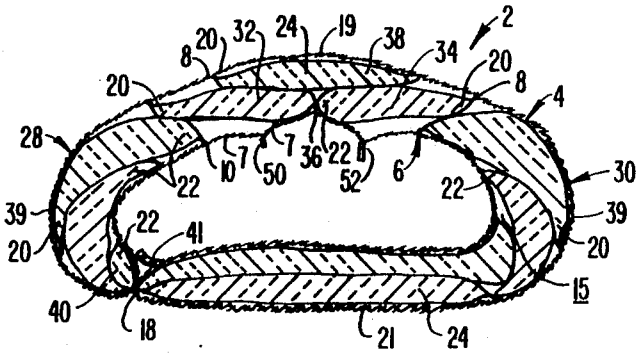
FIG. 2 is a simplified cross-sectional view taken along line 2—2 of FIG. 1 with the zipper elements on the liner separated so the liner is in its full circumference configuration.

In the preferred embodiment of FIG. 2, bag 2 includes a first set 28 of shingled batts 24, positioned on the left hand side of sleeping bag 2 of FIG. 2, and a second set 30 of batts 24. The uppermost batts 32, 34 of first and second sets 28, 30 have their inner longitudinal edges 22 adjacent one another and secured to liner 6 at a center seam allowance 36. A top cover batt 38 has both of its longitudinal edges 20 secured to a seam allowance 11 of shell 4 so batt 38 overlies center seam allowance 36. Accordingly, top cover batt 38 has two outer longitudinal edges 20. First set of batts 28 extends down the sides 39 of bag 2 and along bottom 21 of bag 2 and terminates at access zipper 18. Zipper 18 is positioned along bottom 21 but offset to one side, to the left hand side of bag 2 in the disclosed embodiment. This zipper placement minimizes convection and radiation heat losses at access zipper 18. As is evident from FIG. 2, a half batt 40 is used on one side of zipper 18 to provide dual layers of insulating batts at the zipper.

To reduce convective heat loss through zipper 18 while making sleeping on the zipper comfortable, a relatively thin draft flap 41 is sewn to liner 6 adjacent zipper 18. Draft flap 41 is made of a very flexible insulating material, such as 4.5 oz. THERMOLITE DACRON® polyester thin insulation, THERMOLITE being a DuPont certification mark. Draft flap 41 flexes with zipper 18 to substantially eliminate separation of draft flap 41 from zipper 18, as can occur with conventional bulky draft tubes, to provide superior thermal insulation at the zipper.

Figure 3:
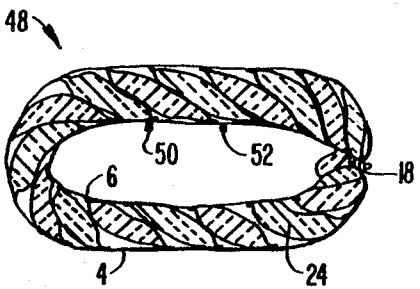
FIG. 3 is a simplified cross-sectional view of an alternative embodiment of the invention.

Other overlapping, shingled arrangements of longitudinally extending batts can be used in lieu of the one shown in FIG. 2. For example, in FIG. 3 a sleeping bag 48 is shown to include batts 24 arranged in the same shingled direction. This arrangement, although providing the advantages inherent with longitudinally arranged shingled batts, however, lacks some of the significant advantages of the embodiment of FIGS. 1 and 2.

Figure 4:
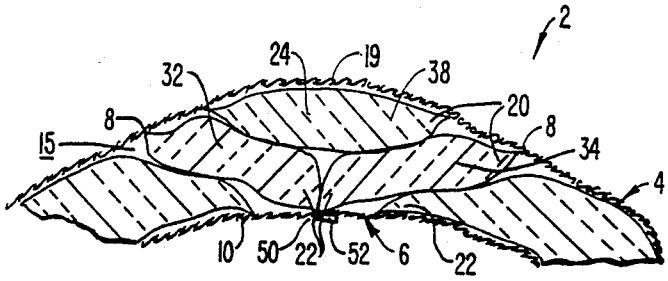
FIG. 4 is a view similar to that of FIG. 2 but showing only the top portion of the sleeping bag with the zipper elements on the liner joined so the liner is in its reduced circumference configuration for increased warmth.

A significant feature of sleeping bag 2 is the ability to adjust the thermal insulation provided by the bag. This is possible by the combination of the arrangement of batts 24 and the provision of zipper elements 50, 52 sewn or otherwise attached to liner 6 on either side of center seam allowance 36. To increase the thermal insulation properties of sleeping bag 2, zipper elements 50, 52 are joined, as shown in FIG. 4, thus reducing the effective circumferential length of liner 6. This causes batts 24 to increase the amount they overlap, which effectively increases the thermal insulating effectiveness of sleeping bag 2. In addition, since the circumference of shell 4 is not substantially affected, the volume of insulating region 15 is increased to provide greater dead air space and an increase in the thermal insulation. Other connection elements, such as buttons and loops or hooks and grommets, could be used instead of zipper elements 50, 52.

Figure 1A:
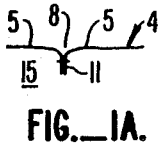
Figure 5:
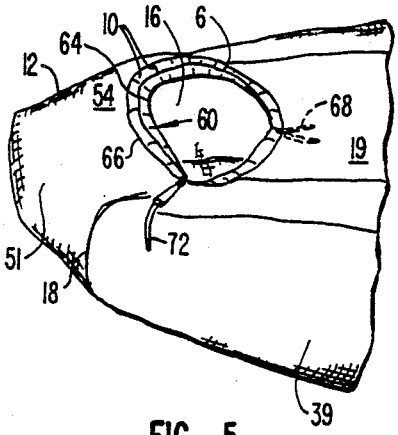
FIG. 5 is an enlarged view of the head of the sleeping bag of FIG. 1.

FIGS. 1 and 5 show the three-dimensional shape of head 12 of sleeping bag 2. Provision of generally vertical side panels 51 between top 19 and bottom 21 of bag 2 helps to prevent compressing the portion 54 of top 19 at head 12 against the user's forehead. This enhances the thermal effectiveness of sleeping bag 2 at head 12.

Figure 6:
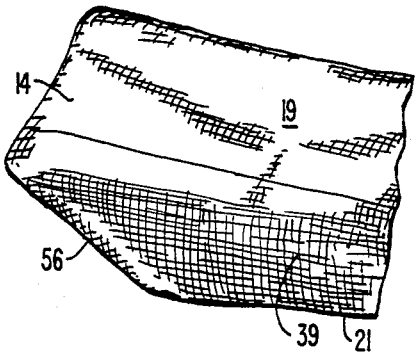
FIG. 6 is an enlarged perspective view of the foot of the sleeping bag of FIG. 1.

Similarly, the thermal effectiveness of sleeping bag 2 at foot 14 is aided by the anatomical design of foot 14, as shown in FIGS. 1 and 6. Bag 2 at foot 14 has an upwardly extending end panel 56 configured to reduce compression of top 19 against the user's feet while reducing bulk and dead air space. The result is a comfortable, thermally efficient design.

Figure 7:
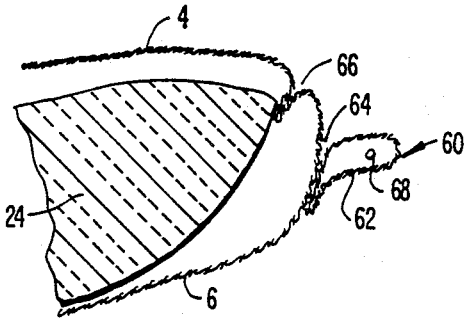
FIG. 7 is a simplified cross-sectional view taken along line 7—7 of FIG. 1, showing the placement of the cord casing spaced apart from the shell/liner seam.

Referring now to FIGS. 1 and 7, a cord casing 60 is secured to liner 6 at head hole 16. Cord casing 60 includes a length of folded over material 62, preferably a thin, flexible insulating material, such as THERMOLITE DACRON® polyester thin insulation, sewn to liner 6 along a line 64 spaced apart from the seam 66 joining shell 4 and liner 6. A drawstring 68 passes through folded over material 62 so the user can reduce the diameter of head hole 16 when desired.

Due to the positioning of cord casing 60 along line 64 spaced apart from shell/liner seam 66, compression of shell 4 at head 12 (which reduces the volume of insulating region 15 at head 12) when drawstring 68 is pulled tight is substantially reduced or eliminated. This is in contrast with the compression which occurs when a cord casing is secured at the shell/liner seam of conventional sleeping bags. The reduction in the compression of shell 4 helps to maintain maximum insulating value of the sleeping bag surrounding head hole 16 even when drawstring 68 has been pulled tight. The use of an insulating material for cord casing 60 also aids achieving maximum thermal insulation.

In use, the user opens zipper 18, while sitting up positions his or her body next to the zipper, and enters sleeping bag 2. The outside zipper pull cord 72 is pulled up as far as comfortable, typically near the user's underarm. Next, the user lays flat with the user's head within head 12 of bag 2, and the user's body centered in the bag, the user brings his or her arm which is away from access zipper 18 (the left arm in the disclosed embodiment) out of bag 2 and across the user's body so to grasp outside zipper pull cord 72 and pulls the zipper pull cord until zipper 18 is completely closed. To exit bag 2, the user may place both hands on either side of zipper 18 adjacent head hole 16 and pull zipper 18 apart. When desired, head hole 16 can be reduced in size by pulling on drawstring 68: this provides extra thermal insulation at head 12 of bag 2. For greater overall thermal insulation, zipper elements 50, 52 are joined together, thus reducing the effective circumferential length of liner 6 and causing greater overlap of batts 24.

Modification and variation can be made to the disclosed embodiments without departing from the subject of the invention as defined by the following claims. For example, various elements are said to be joined by sewing; other methods of fastening can be used as well.

What is claimed is:

1. A sleeping bag comprising:

an outer shell;

an inner liner within the outer shell to define a space therebetween:

the shell and the liner joined at a user access region: and a plurality of longitudinally extending insulation batts housed within the space, each batt comprising a unitary body with edges secured to the shell and/or the liner the batts arranged in an overlapping, shingled arrangement for enhanced insulation effectiveness.

2. The sleeping bag of claim 1 wherein a portion of the user access region defines a head hole.

3. The sleeping bag of claim 2 wherein the shell and the liner are joined at the head hole at a shell/liner seam.

4. The sleeping bag of claim 3 further comprising a drawstring and a flexible guide, through which the drawstring passes, secured to the liner along a line near but spaced apart from shell/liner seam by a chosen distance so that when the drawstring is pulled, compression of the shell surrounding the head hole is minimized.

5. The sleeping bag of claim 4 wherein the flexible guide includes a thin, flexible insulating material.

6. The sleeping bag of claim 1 wherein the shell includes longitudinally extending shell panels joined at shell panel seams, the shell panel seams having shell seam allowances extending into said space between the shell and the liner.

7. The sleeping bag of claim 6 wherein the batts are secured to the shell along the shell seam allowances.

8. The sleeping bag of claim 1 wherein the batts have longitudinal edges.

9. The sleeping bag of claim 8 wherein at least some of the batts are secured to the shell and to the liner along their longitudinal edges.

10. The sleeping bag of claim 8 including a first set of batts having inner longitudinal edges secured to the liner and outer longitudinal edges secured to the shell.

11. The sleeping bag of claim 1 wherein at least some of the batts are secured to both the shell and to the liner.

12. The sleeping bag of claim 1 wherein the sleeping bag includes a top and a bottom.

13. The sleeping bag of claim 12 wherein a part of the user access region extends along the bottom of the sleeping bag.

14. The sleeping bag of claim 13 wherein the user access region starts at the top of the sleeping bag.

15. The sleeping bag of claim 1 wherein the user access region includes an access zipper.

16. The sleeping bag of claim 15 wherein the user access region includes a thin, flexible draft flap covering the access zipper.

17. The sleeping bag of claim 16 wherein the sleeping bag includes a top and a bottom and the access zipper is at the bottom.

18. The sleeping bag of claim 17 wherein the access zipper extends from a position at the top of the sleeping bag.

19. The sleeping bag of claim 17 wherein the bottom has a bottom centerline and the zipper is spaced apart from the bottom centerline.

20. The sleeping bag of claim 1 further comprising a head portion and a foot portion.

21. The sleeping bag of claim 20 wherein the head portion including upwardly extending head portion panels to define a three dimensional head cavity.

22. The sleeping bag of claim 20 wherein the foot portion includes upwardly extending foot portion panels to define a three dimensional foot cavity.

23. A sleeping bag comprising:

an outer shell;

an inner liner within the outer shell to define a space therebetween;

the shell and the liner joined at a user access region;

a plurality of longitudinally extending insulation batts housed within the space, the batts arranged in an overlapping, shingled arrangement for enhanced insulation effectiveness; and means for reducing the circumferential dimension of the liner along at least a portion of the length of the liner to increase the amount of overlap of the batts.

24. The sleeping bag of claim 23 wherein the reducing means includes spaced apart, longitudinally extending fastener elements secured to the liner, the fastener elements adapted to be joined and separated to change the circumferential dimension of the liner.

25. The sleeping bag of claim 24 wherein the fastener elements include zipper elements.

26. A sleeping bag comprising:

an outer shell;

an inner liner within the outer shell to define a space therebetween;

the shell and the liner joined at a user access region;

a plurality of longitudinally extending insulation batts housed within the space, the batts having longitudinal edges and arranged in an overlapping, shingled arrangement for enhanced insulation effectiveness; and first and second sets of the batts having inner longitudinal edges secured to the liner and outer longitudinal edges secured to the shell, the first and second sets of batts being shingled in opposite circumferential directions.

27. The sleeping bag of claim 26 wherein the first and second sets of batts each have end batts, the end batts having their respective inner longitudinal edges opposed.

28. The sleeping bag of claim 27 including a cover batt opposite the inner longitudinal edges of the end batts, the longitudinal edges of the cover batt secured to a chosen one of the shell and the liner.

29. The sleeping bag of claim 28 wherein the cover batt is secured to the outer shell at a top surface of the outer shell.

30. A sleeping bag comprising:

an outer shell:

an inner liner within the outer shell to define a space therebetween;

insulation positioned in the space;

the shell and the liner joined at a user access opening region, a portion of the user access opening region having a shell/liner seam defining a head hole; and a cord casing including a drawstring and a flexible guide, through which the drawstring passes, secured to the liner along a line by a chosen distance from the shell/liner seam so that when the drawstring is pulled, compressing of the shell surrounding the head hole is minimized.

31. A sleeping bag comprising:

an outer shell;

an inner liner within the outer shell to define a space therebetween;

the shell and the liner joined at a user access opening region;

insulation within the space; and zipper means for reducing the circumferential dimension of the liner along the length of the liner to increase the volume of the space.

32. A sleeping bag comprising:

an outer shell;

an inner liner within the outer shell to define a space therebetween;

the shell and the liner joined at a user access region;

a plurality of longitudinally extending insulation batts housed within the space, the batts having longitudinal edges and arranged in an overlapping, shingled arrangement for enhanced insulation effectiveness; and a first batt having both longitudinal edges secured to the shell, second and third batts having opposed longitudinal edges generally abutting and secured to the liner adjacent a central portion of the first batt, the other longitudinal edges of the second and third batts secured to the shell.

* * * * *